United States Patent [19]

Schnürle et al.

[11] 4,320,732

[45] Mar. 23, 1982

[54] METHOD AND APPARATUS FOR GENERATING FUEL INJECTION CONTROL PULSES FOR AN INTERNAL COMBUSTION ENGINE

[75] Inventors: Hans Schnürle, Walheim; Ulrich Drews, Vaihingen-Pulverdingen; Peter Werner, Wiernsheim-Iptingen, all of Fed. Rep. of Germany

[73] Assignee: Robert Bosch GmbH, Stuttgart, Fed. Rep. of Germany

[21] Appl. No.: 26,159

[22] Filed: Apr. 2, 1979

[30] Foreign Application Priority Data

Jun. 1, 1978 [DE] Fed. Rep. of Germany ..... 2824007

[51] Int. Cl.³ ..... F02M 51/02

[52] U.S. Cl. ..... 123/478; 123/427

[58] Field of Search ..... 123/32 EA

[56] References Cited

U.S. PATENT DOCUMENTS

| | | | |
|---|---|---|---|
| 3,548,791 | 12/1970 | Long | 123/32 EA |
| 3,750,631 | 8/1973 | Scholl et al. | 123/32 EA |
| 4,084,552 | 4/1978 | Drews et al. | 123/32 EA |
| 4,092,955 | 6/1978 | Reddy | 123/32 EA |
| 4,121,545 | 10/1978 | Mizote | 123/32 EA X |
| 4,195,599 | 4/1980 | Luchaco | 123/32 EA |

*Primary Examiner*—Tony M. Argenbright

*Attorney, Agent, or Firm*—Edwin E. Greigg

[57] ABSTRACT

A method and an apparatus for generating fuel metering control pulse which may be used to control the operation of injection systems, carburetors, or any other controllable fuel metering mechanism. The system includes two signal generators one of which continually generates a signal related to engine conditions while the other is engaged in deriving therefrom a fuel metering control pulse of appropriate length. The duration of the pulses may be obtained by the charging and discharging constant of control capacitors or by a process of numerical countdown of digital data.

20 Claims, 6 Drawing Figures

Trigger
Q̇ corr
Start
ti min
10
11
12
13
14
15
17
18
19
20
21
22
23
24
25

Q̇
Trigg
10
11
12
13
15
17
18
21
25
30
31
32
34
35

Corr.
Corr.
Trigg
Start
timing

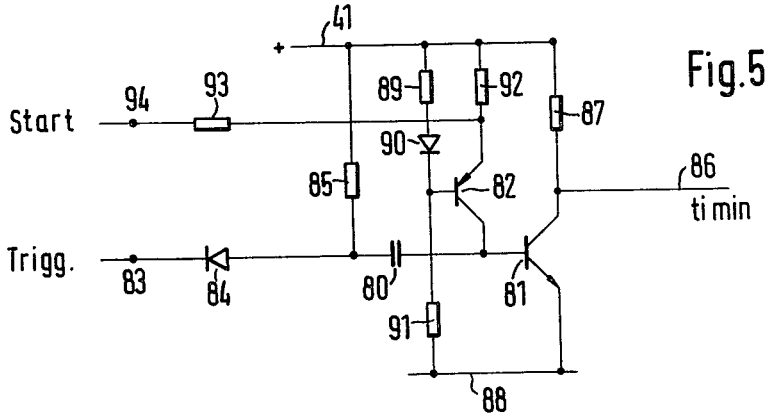
Fig.5
Fig.6
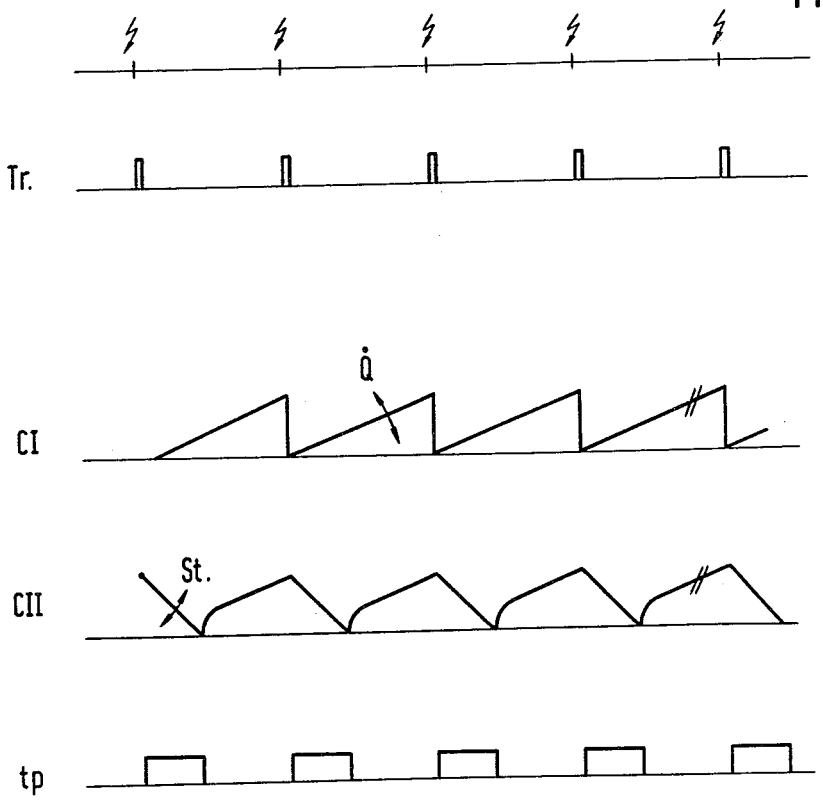

METHOD AND APPARATUS FOR GENERATING FUEL INJECTION CONTROL PULSES FOR AN INTERNAL COMBUSTION ENGINE

FIELD OF THE INVENTION

The invention relates to the fuel management of internal combustion engines. More particularly, the invention relates to fuel management systems in which electrical fuel metering pulses are continuously generated on the basis of operational engine variables. The pertinent field of the invention includes both fuel injection systems and carburetor systems.

BACKGROUND OF THE INVENTION

Known in the art are electronic circuits for generating fuel injection control pulses in which a capacitor is charged at a rate depending on the magnitude of some operational variable. In a second time interval and after the occurrence of a trigger pulse, the time required to discharge the capacitor is used to determine the duration of the fuel injection time. After the capacitor is discharged, the system rests until the occurrence of the subsequent charging cycle. The charging and discharging cycles follow one another sequentially. It is an inherent disadvantage of the known system that, while the capacitor is discharging and while the system is in its rest phase, the voltage across the capacitor is not related to the magnitude of the operational control variable of the engine. Accordingly, the system does not have available a continuous control variable.

OBJECT AND SUMMARY OF THE INVENTION

It is thus a principal object of the present invention to provide a fuel management system in which a control variable is at all times available to the system. This object is attained, according to the invention, by providing a method and an apparatus for the continuous generation of an electrical value which depends on at least one operational variable and serving as the control signal for the fuel metering pulse. The apparatus for carrying out the aforementioned method includes at least one signal generator for generating an output signal related to the operational variable which is then converted into a fuel metering pulse by an amplitude-to-pulse duration converter. The signal generator may be for example a capacitor with controllable charging and discharging current sources and the signal is taken over as a voltage in a second capacitor whose discharge is also controlled, thereby generating the fuel metering signal during the discharge process.

It is a particular advantage of the method of the invention that the response time of the fuel metering system to changes in the operational variables is very short, for example during the transition from acceleration to deceleration or vice versa. The response time is short because the fuel metering signal can be derived at any moment from a signal which is directly related to the prevailing operational variable. It is thus possible to monitor the aspirated air quantity, for example, at all times.

In an advantageous embodiment of the invention, the continuous signal related to the operational variable is generated in a first signal generator and is converted when necessary into a fuel metering signal in a second signal generator.

The invention will be better understood as well as further objects and advantages thereof become more apparent from the ensuing detailed description of preferred exemplary embodiments of the invention taken in conjunction with the drawing.

BRIEF DESCRIPTION OF THE DRAWING

FIG. 5 is a circuit diagram of an auxiliary circuit for generating pulses during engine starting; and FIG. 6 is a timing diagram illustrating signals and pulses in a variant of the method according to the invention.

DESCRIPTION OF THE PREFERRED EXEMPLARY EMBODIMENT

Figure 1:
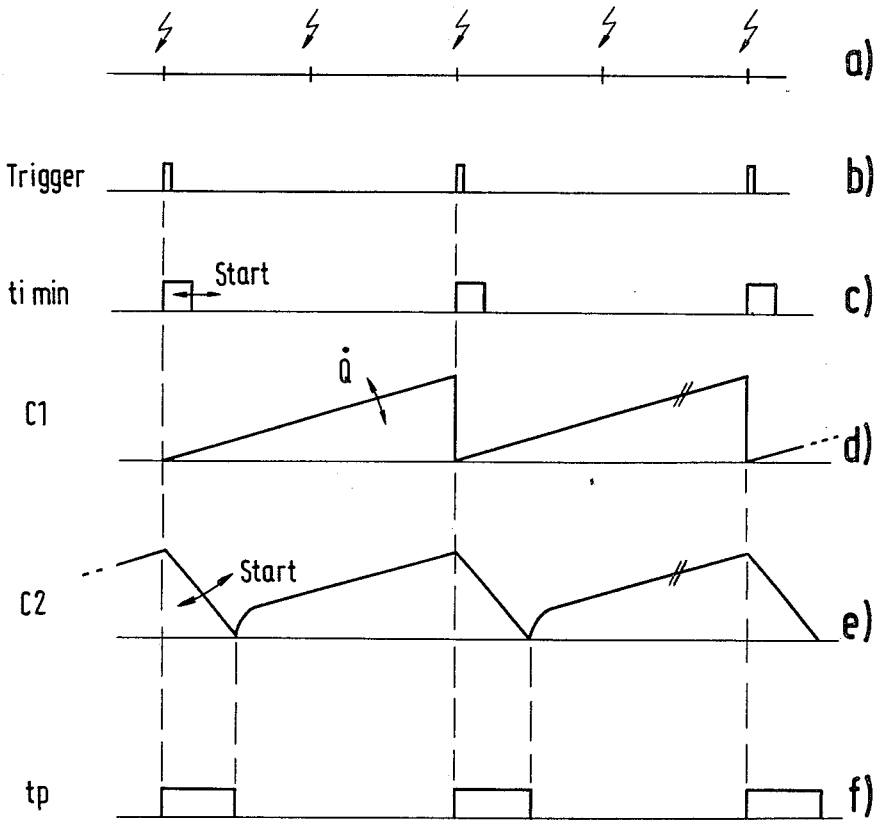
FIG. 1 is a timing diagram illustrating a sequence of pulses and signals for demonstrating the method according to the invention.

Turning now to FIG. 1, there will be seen a set of timing diagrams related to the operation of an internal combustion engine with spark plug ignition. The occurrence of the sparks is shown in FIG. 1*a*. Every other ignition spark is used to generate a triggering pulse as illustrated in FIG. 1*b* which causes the generation of a minimum fuel control pulse $t_{i\ min}$ shown in FIG. 1*c*. These minimum control pulses are generated by a monostable multivibrator and their duration can be changed, especially during engine starting. FIG. 1*d* shows the output signal (first electrical signal) of a first signal generator which may be for example the voltage across a capacitor which is seen to increase at the occurrence of the trigger signal due to the charging of the capacitor. The charging rate, i.e., the slope of the ramp in FIG. 1*d*, depends on the air flow rate through the induction tube of the engine, constituting an operational variable. Accordingly, there is available at any point of time a value which is equal to the quotient of the air flow rate and the engine speed. It will be seen that the signal is continuous and represents especially the aspirated air quantity without time gaps which are inherent in the apparatus known in the art.

The output signal (second electrical signal) of a second signal generator is shown in FIG. 1*e*. The first portion of this second signal represents the discharging process of a capacitor until a particular threshold is reached; for example, and preferably, the value 0. A subsequent phase of the signal represents a relatively rapid adjustment of the second signal to the output signal of the first signal generator, whereafter the first and second signals increase in parallel.

FIG. 1*f* is a diagram showing the final fuel control pulses whose duration is equal to the duration of the discharging phase in the first portion of the second output signal illustrated in FIG. 1*e*.

Inasmuch as the first signal generator generates a continuous signal related to the operational variable, the second signal generator is enabled to provide a fuel metering pulse at relatively short intervals because, at the termination of the fuel control pulse $t_p$, the second signal generator output rapidly adjusts to the value of the signal generated by the first signal generator. In principle, the second signal generator could produce an output pulse immediately after the expiration of a previous output pulse.

Figure 2:
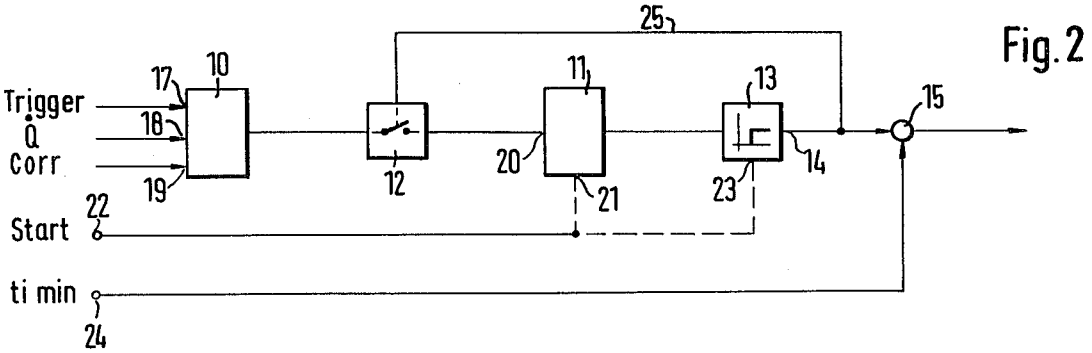
FIG. 2 is a simplified block diagram of an electronic circuit constituting the apparatus of the invention.

The various signal trains shown in FIG. 1 may be produced by an apparatus depicted in the block diagram of FIG. 2. Shown there is a first signal generator 10, whose output signal passes through a switch 12 to a second signal generator 11. The output of the signal generator 11 goes to a threshold switch 13 whose output controls the aforementioned switch 12 and which is also applied to a junction 15 from which a power output or driver circuit controls the operation of the fuel injection valves of the engine.

The signal generator 10 has inputs 17, 18 and 19, which receive, respectively, a trigger signal, an air flow rate signal and a correction signal. The second signal generator 11 has a signal input 20 and a control input 21, the latter serving, for example, to receive an engine starting signal applied to a contact 22. The same starting signal can be applied selectively to the threshold switch 13 which reacts to the signal put out by the second signal generator 11. The application of the starting signals to the circuits 11 and 13 is selective as shown by the dashed lines. Provision is further made of the application of a minimum-length fuel control pulse $t_{i\,min}$ onto a contact 24 from which it is transmitted to the aforementioned circuit junction 15. The switch control signal for actuating the switch 12 travels from the output of the threshold switch 13 to the switch 12 via a line 25. The switch 12 is closed except during the time that a fuel control signal is being generated by the circuit.

Figure 3:
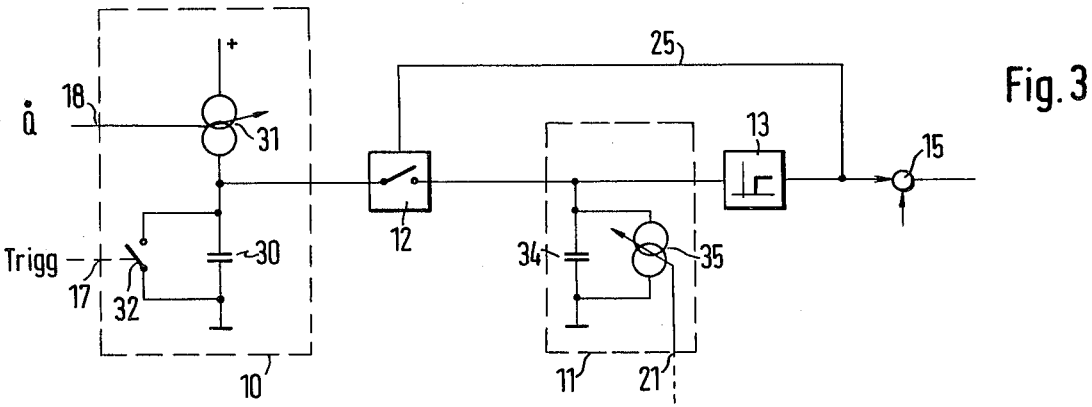
FIG. 3 is a simplified circuit diagram illustrating portions of the apparatus shown in FIG. 2.

The major elements of the circuit shown in FIG. 2 are illustrated in greater detail in FIG. 3. The first signal generator 10 shown within a dashed enclosure is seen to include a control capacitor 30 connected to a charging mechanism 31 and a discharging mechanism 32. The mechanism 32 is a switch that is opened and closed by the trigger pulses applied to the input 17. As will be seen by reference to the timing diagram of FIG. 1*d*, the discharge of the capacitor 30 should proceed as rapidly as possible so as to make available a nearly continuous signal related to the operational engine variable. The charging control mechanism 31 is engaged at a contact 18 by a signal related to the air flow rate $\dot{Q}$ so as to make the increase of the voltage across the capacitor 30 dependent thereon.

The second signal generator 11 contains a control capacitor 34 connected in parallel to a current source 35. Provision may be made via a line 21 to uncouple the discharging current source 35 from the capacitor 34 during the charging phase of the capacitor 34 so as to insure a faultless adaptation of the voltage across the capacitor 34 to the voltage on the capacitor 30.

The function of the circuit illustrated in FIG. 3 is as follows: A trigger pulse causes as complete a discharge of the capacitor 30 as possible. During the discharging period, the closed switch 32 also drains the current from the current source 31. This current depends in magnitude on the air flow rate in the induction tube so that after the trigger pulse disappears, the capacitor 30 is charged at a rate which depends on the air flow rate and which, if the air flow rate is constant, results in a linear charging rate of the capacitor until the arrival of the next trigger pulse.

The trigger pulse also opens the switch 12 by means to be described below so that the capacitor 34 is disconnected from the current source 31. The discharging current source 35 lies in parallel with the capacitor 34 so that when the switch 12 is opened, the capacitor 34 discharges and this process is monitored by the threshold switch 13 which terminates that process when the threshold is crossed by activating the switch 12. It will thus be appreciated that the trigger pulse opens the switch 12, but the closure of the switch 12 depends on the time at which the capacitor voltage reaches the predetermined threshold. This threshold may be selected to conform to the characteristics of the various circuit components and may, in particular, be equal to or near the value 0 as illustrated for example in FIG. 1*e*. After the switch 12 is opened, the two capacitors 30 and 34 are again connected in parallel so that the voltage at the junction of the switch 12 and the second signal generator 11 rapidly rises to the prevailing voltage across the capacitor 30 in the signal generator 10.

Inasmuch as the output signal of the circuits in FIGS. 2 and 3 starts with a trigger signal but is terminated when the capacitor voltage crosses a certain threshold, the switch 12 must be controlled by a holding circuit which will be described in connection with the illustration of FIG. 4.

Figure 4:
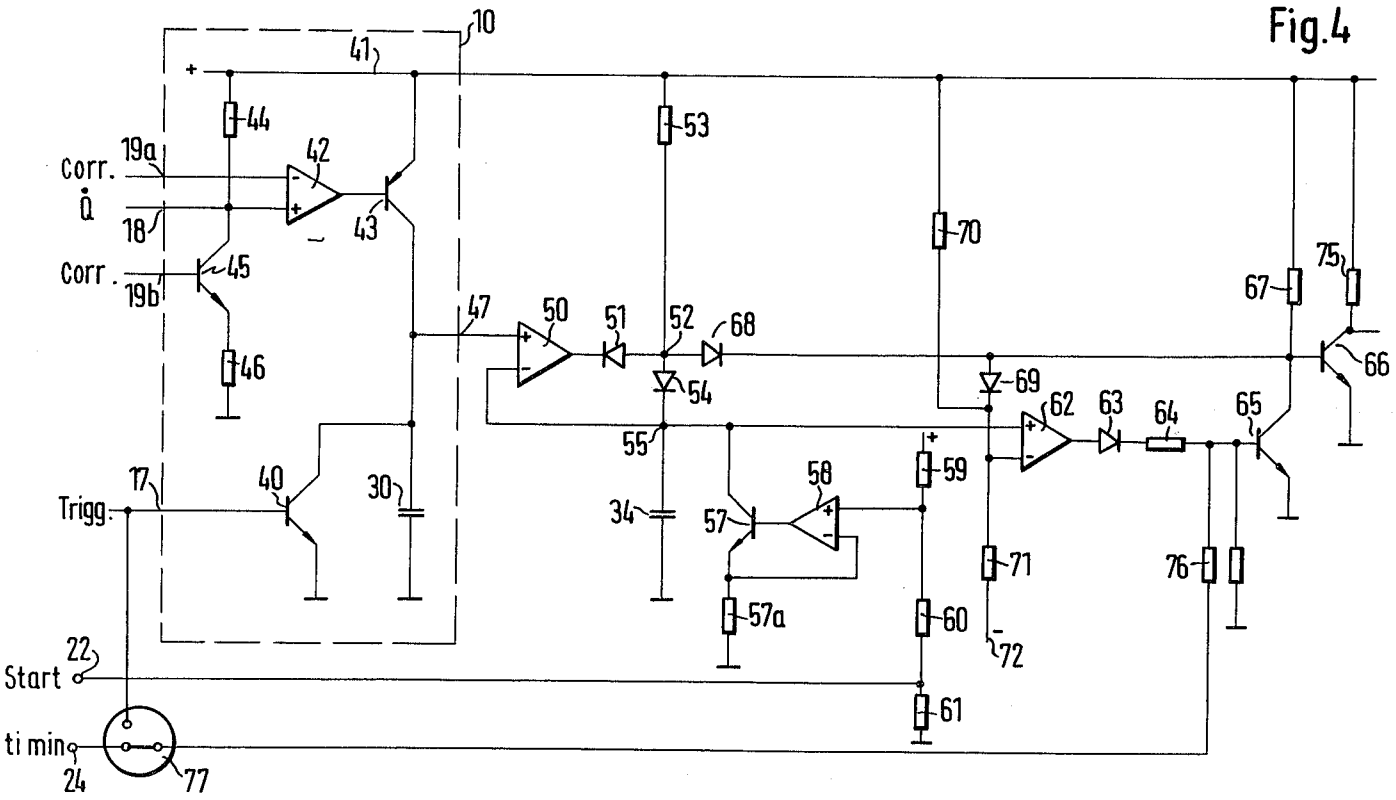
FIG. 4 is a detailed circuit diagram of the apparatus of FIG. 3.

FIG. 4 is a detailed circuit diagram of one embodiment of the apparatus for carrying out the method according to the invention. The major components of the circuit of FIG. 4 represent the various blocks in FIGS. 2 and 3.

The first signal generator 10, surrounded in FIG. 4 by dashed lines, includes the aforementioned control capacitor 30 connected in parallel with a transistor 40 whose base is connected to the triggering input 17. Connected between the capacitor 30 and a positive power supply line 41 is a transistor 43 controlled by an operational amplifier 42. The inverting input of the operational amplifier 42 receives a correction signal at a point 19*a* and the non-inverting input of the operational amplifier 42 receives a signal related to an operational engine variable, in the present example the air flow rate $\dot{Q}$, i.e., the amount of air flowing through the induction tube. The non-inverting input of the operational amplifier 42 is also connected to the collector of a transistor 45 whose emitter is grounded through a resistor 46. The base of the transistor 45 serves to apply a further correcting signal 19*b* to the signal generator 10.

The transistor 43 constitutes the current source for charging the capacitor 30. The magnitude of the charging current can be adjusted by applying appropriate signals at the inputs 18, 19*a*, and 19*b*. The principal factor which affects the capacitor voltage is the air flow rate signal applied to the input 18 but the signals applied to the inputs 19*a* and 19*b* make possible small corrections of that voltage.

The output 47 of the first signal generator 10 is connected to one input of an amplifier 50 whose output is connected to the cathode of a diode 51. The anode of the diode 51 is coupled to a circuit junction 52 which is connected through a resistor 53 to the positive supply line 41 and further connected through a diode 54 to a second circuit junction point 55. Connected between the junction 55 and the ground bus of the circuit is the control capacitor 34 which is a principal component of the second signal generator 11 of FIG. 2. Connected in parallel to the capacitor 34 is a series connection of a resistor 57*a* and a transistor 57 whose base is controlled by the output of an operational amplifier 58 which has an input connected to the tap of a voltage divider consisting of resistors 59, 60 and 61, all connected in series between opposite power supply lines. The junction of the resistors 60 and 61 is connected to the input 22 to receive an engine starting signal. The inverting input of the amplifier 58 is connected to the emitter of the transistor 57 and to the resistor 57*a*.

The junction point 55 is also connected with the inverting input of the amplifier 50 as well as to the positive input of a threshold switch consisting of an amplifier 62. The output of the amplifier 62 goes to a diode 63 and a resistor 64 to the base of a transistor 65 whose collector is joined to the base of a further transistor 66. The base of the transistor 66 is also connected via a resistor 67 to the positive power supply line 41 and further to a diode 68 to the junction point 52 as well as via a diode 69 to the junction of resistors 70 and 71 connected in series between the positive and negative power supply lines. Also connected to the junction of the resistors 70 and 71 is the inverting input of the amplifier 62. The output signal of the circuit which is illustrated in FIG. 1*f* is taken from the collector of the transistor 66 which is also connected to the positive power supply line through a resistor 75. The base of the transistor 65 can be controlled by the input contact 24 acting through a selector switch 77 and a resistor 76. The selector switch 77 can place on the base of the transistor 65 either the trigger pulse received at the input 17 or a minimum fuel control signal received at the input 24.

The circuit illustrated in FIG. 4 functions as follows:

The transistor 43 controls the current applied to the capacitor 30 which is thus charged according to a preselected curve. Prior to the arrival of a triggering pulse or a minimum fuel control pulse $t_{i\ min}$, the transistor 65 may be assumed to be blocked, thereby rendering the transistor 66 conducting so that its collector is near or at ground potential as is the output of the entire circuit.

The voltage across the capacitor 30 now controls the amplifier 50 whose output governs the voltage present at the junction point 52. The same voltage is applied through the diode 54 to the junction point 55 and hence to the capacitor 34 which thus imitates the charging process taking place in the capacitor 30. The transistor 57 is held conducting at a rate which prevents current being drained from the capacitor 34 during the charging process. During this time, the output of the threshold switch 62 is too low to render the transistor 65 conducting so that its collector voltage is high, as is the inverting input of the amplifier 62, preventing the latter from generating a switching signal.

Upon the occurrence of a trigger signal at the contact 17, and the conduction of transistor 40, the capacitor 30 is rapidly discharged. At the same time, the transistor 65 is rendered conducting so that its collector voltage drops. Accordingly, the transistor 66 blocks and the output of the entire circuit rises to a high voltage.

The drop in the collector voltage of the transistor 65 also causes conduction of the diode 68 which places the junction 52 at ground potential via the transistor 65 and causes the uncoupling of the junction 5 and the capacitor 34 from the junction 52. As a consequence, the capacitor 34 is discharged at a selectable rate by the transistor 57.

The transistor 57, the amplifier 58 and the resistor 57*a* together constitute a constant current source.

The conduction of the transistor 65 blocks the diode 69 and the voltage at the inverting input of the amplifier 62 decreases. This decrease causes a response of the threshold switch whose output signal goes high and keeps the transistor 65 in conduction even after the trigger pulse received through the resistor 76 has disappeared. The transistor 65, the diode 69 and the voltage divider 70, 71 together constitute a latching circuit for the threshold switch 62. A change in conditions does not occur until the voltage at the non-inverting input of the amplifier 62 falls below a predetermined threshold, thereby causing the output signal of the amplifier 62 to drop. The corresponding drop in the base voltage of the transistor 65 causes a rise in the collector voltage which renders the diode 69 conducting and causes a rise at the inverting input of the amplifier 62, returning the latter to its quiescent state. According to the foregoing, the output of the entire circuit rises at the occurrence of a triggering pulse and drops when the voltage across the capacitor 34 falls below a predetermined threshold.

The rate of discharge of the capacitor 34 may be controlled by controlling the current through the transistor 57 at the input 22, for example, in order to increase the fuel injection control pulse during engine starting, thereby providing an increased amount of fuel to the engine.

The minimum fuel injection control pulse $t_{i\ min}$ applied at the contact 24 is generated by a circuit which may be built as illustrated in FIG. 5 and may be made dependent on the occurrence of engine starting. The circuit shown in FIG. 5 includes a simplified monostable multivibrator having a capacitor 80, a transistor 81 and a controllable constant current source including a further transistor 82. A triggering input 83 is connected through a diode 84 to the aforementioned capacitor 80 and to a resistor 85, the other electrode of which is connected to a positive power line 41. The emitter of the transistor 81 is grounded and its collector constitutes the output 86 of the circuit. The collector of the transistor 81 is also connected to the positive line 41 through a resistor 87. Coupled to the base of the transistor 81 is a current source including the transistor 82, the base of which is connected to the junction of a resistor 91 and a diode 90 which are connected in series with a resistor 89 between the positive and negative power supply buses. The emitter of the transistor 82 is connected to the bus 41 through a resistor 92 as well as being connected through a resistor 93 to a contact 94 which receives the engine starting signal.

A negative-going triggering pulse at the contact 83 causes a crop of the base voltage of the transistor 81 resulting in an increase of the collector voltage which constitutes the output voltage of the circuit at the point 86. On the other hand, the current source and its transistor 82 tend to increase the voltage at the base of the transistor 81, causing the latter to become conducting after the expiration of a certain period of time whereupon the output voltage drops again. The magnitude of the charging current through the resistor 82 and hence the duration of the output pulse $t_{i\ min}$ can be controlled by applying a suitable signal at the point 94. The amount of fuel supplied to the engine may thus be changed independently of any change due to the variable air flow rate in the induction tube.

The manner of generating the fuel injection control pulses may be varied, for example as illustrated in FIG. 6. In this set of diagrams, the triggering signals are seen to be generated for each and every occurrence of the ignition pulses rather than every other time as was the case in the example of FIG. 1. This more frequent trigger pulse generation may be chosen if it is desired to produce a more homogeneous mixture in the region downstream of the fuel metering location in the induction tube.

The method and apparatus of the invention as described and illustrated above may advantageously be employed in fuel injection systems for internal combustion engines but may also be used profitably in any controlled fuel management system, in particular with controlled carburetors and the like.

Furthermore, the foregoing relates to merely preferred exemplary embodiments of the invention, it being understood that other embodiments and variants thereof are possible within the spirit and scope of the invention.

For example, while according to the preferred embodiment capacitors are utilized to produce the desired first and second electrical signals, it should be understood that digital components, such as counters, could be utilized instead. Certainly the use of digital components instead of analogue components, such as capacitors, would be apparent to one of ordinary skill in the art.

What is claimed and desired to be secured by Letters Patent of the United States is:

1. A method for generating fuel metering control pulses for an internal combustion engine, comprising the steps of:

generating a first electrical signal which varies as a function of an operational variable of the engine, said first electrical signal being continuous and periodic, and having two portions between its periodic limits;

generating a second electrical signal which is continuous and periodic, with a period substantially equal to the period of said first electrical signal, said second electrical signal having two portions of opposite slope between its periodic limits, with one of said portions varying as a function of said operational variable of the engine such that a substantial portion of its profile matches the profile of one of the two portions of said first electrical signal; and generating a fuel metering control pulse, the width of which corresponds to the period of one of the two portions of the second electrical signal.

2. A method according to claim 1, comprising the further step of generating a trigger pulse which initiates the generation of said first and second electrical signals.

3. A method according to claim 2, wherein said trigger pulse is derived from the ignition pulses of the engine.

4. A method according to claim 1, wherein the first electrical signal is generated from the output of a storage medium.

5. A method according to claim 1, wherein the second electrical signal is generated from the output of a storage medium.

6. A method according to claim 1, wherein said first electrical signal contains information regarding the air flow rate through the induction tube of the engine, and wherein the instantaneous value of said second electrical signal is used at selectable points of time for determining the duration of said fuel metering control pulse.

7. A method according to claim 1, wherein the first and second electrical signals are generated by the outputs of respective storage media, and wherein the outputs of each respective storage medium includes a charging and discharging between the occurrence of two successive trigger pulses.

8. A method according to claim 7, wherein the width of said fuel metering control pulse is determined by the discharging output of the storage medium which generates the second electrical signal.

9. A method according to claim 7, including the further step of preparing a value related to the operational variable in the first storage medium, transferring this value to the second storage medium and using the value stored in the second storage medium as the output signal for determining the width of said fuel metering control pulses.

10. An electronic control system for generating fuel metering control signals for an internal combustion engine, comprising:

a first signal generator for generating a first electrical signal which varies as a function of an operational variable of the engine, said first electrical signal being continuous and periodic, and having two portions between its periodic limits;

a second signal generator connected to the first signal generator to receive said first electrical signal for generating a second electrical signal which is continuous and periodic, with a period substantially equal to the period of said first electrical signal, said second electrical signal having two portions of opposite slope between its periodic limits, with one of said portions varying as a function of said operational variable of the engine such that a substantial portion of its profile matches the profile of one of the two portions of said first electrical signal; and means connected to the second signal generator for generating a fuel metering control pulse, the width of which corresponds to the period of one of the two portions of the second electrical signal.

11. A system according to claim 10, wherein said first electrical signal is transferred to said second signal generator, and wherein said second signal generator includes means for performing a charging process to determine the width of said fuel metering control pulses.

12. A system according to claim 10, further comprising means for coupling said second signal generator to said first signal generator after termination of the operational phase which determines the width of said fuel metering control pulses.

13. A system according to claim 10, further comprising trigger means for triggering the onset of the first and second electrical signals.

14. A system according to claim 10, wherein at least one of said first and second signal generators includes storage means.

15. A system according to claim 14, wherein at least one of said first and second signal generators includes a capacitor having a controllable charging and discharging stage.

16. A system according to claim 15, wherein at least one of said charging or discharging stage is controllable in dependence on at least one operational variable.

17. A system according to claim 16, comprising means for supplying a signal related to an operational variable to the storage means in said first signal generator.

18. A system according to claim 17, comprising means for applying trigger pulses to reset the storage means in said first signal generator and further comprising means for selecting the ratio of the number of trigger pulses to the number of ignition pulses of the engine.

19. A system according to claim 10, further comprising a holding circuit, and wherein the output signal from said system can be set by a triggering pulse and can be held by the holding circuit until the value of said second signal generator crosses a selectable threshold.

20. A system according to claim 10, further comprising means for generating a minimum fuel metering control pulse on the basis of engine conditions.

* * * * *